US006158080A

United States Patent [19]

Schlapkohl

[11] Patent Number: 6,158,080

[45] Date of Patent: Dec. 12, 2000

[54] ULTRA-COMPACT RECESSED WALL MOUNTED VACUUM CLEANER

[76] Inventor: Peter Schlapkohl, 199 Shelter La., Jupiter, Fla. 33469

[21] Appl. No.: 09/225,169

[22] Filed: Jan. 4, 1999

[51] Int. Cl.[7] ..... A47L 5/38

[52] U.S. Cl. ..... 15/301; 15/314; 15/352

[58] Field of Search ..... 15/301, 314, 350, 15/352

[56] References Cited

U.S. PATENT DOCUMENTS

| | | | |
|---|---|---|---|
| 1,887,600 | 11/1932 | Replogle | 15/335 |
| 3,023,447 | 3/1962 | Senne | 15/314 |
| 3,213,480 | 10/1965 | Miller | 15/314 |
| 3,422,482 | 1/1969 | Hamrick | 15/314 |
| 3,568,239 | 3/1971 | Hamrick | 15/314 |
| 3,704,482 | 12/1972 | Brannon | 15/351 X |
| 3,706,184 | 12/1972 | Tucker . | |
| 3,714,765 | 2/1973 | Simonelli | 15/314 X |
| 3,783,472 | 1/1974 | Mol . | |

*Primary Examiner*—Chris K. Moore
*Attorney, Agent, or Firm*—McHale & Slavin

[57] ABSTRACT

The present invention is directed to improvements in the operation and design of wall-mounted recessed vacuum cleaner systems. The invention advantageously incorporates an extremely compact motor design which enables the filtering debris receptacle to be arranged directly over the motor housing. The vacuum system of the instant invention is characterized by an upper containment compartment and a lower evacuation compartment. The containment compartment houses an air filtering and residue collecting receptacle, e.g. a vacuum bag assembly, which may incorporate HEPA filtration characteristics.

2 Claims, 7 Drawing Sheets

ULTRA-COMPACT RECESSED WALL MOUNTED VACUUM CLEANER

FIELD OF THE INVENTION

This invention relates to the field of wall mounted vacuum cleaners and particularly to uniquely configured self-contained units capable of being totally recessed within an interior wall.

BACKGROUND OF THE INVENTION

Central vacuum cleaning systems are useful in homes, offices and commercial establishments. These systems generally utilize a unitary centrally located station containing a vacuum supply, a collection receptacle and a plurality of conduits which interconnect various parts of the structure to the central station. The conduits normally terminate in a hose adapter coupling enabling each area to be cleaned by inserting the hose assembly into the hose coupling and activating the central station vacuum supply. The hose assembly is normally moved from one room to another. In some systems the hose coupling also supplies electrical power to a brushing system, sometimes referred to as a powerhead.

These systems suffer from the fact that an extremely powerful unit must be utilized in order to compensate for the pressure drop experienced in traversing the various heights and bends needed to route the conduit through the walls of the structure. Furthermore, prior art central vacuum systems have historically been limited to inclusion in only new construction since it is both difficult and costly to install the necessary conduits in existing structures.

In addition, as the air filtering and residue collecting receptacle becomes filled, there is a tendency for the airflow around it to be impaired as it presses against the inner walls of its housing. The instant invention incorporates a unique baffle assembly which advantageously lines the inner walls of the housing around the collection receptacle and maintains an unimpeded flow path so as to insure optimum operation, even as the receptacle becomes filled.

Wall recessed cleaning systems are known that are self-contained so as to include the vacuum supply, vacuum bag and hose receptacle in a single unit, adapted to be situated within an opening prepared in the wall of an existing structure. The problem with such prior art devices was that they were difficult to install within an interior wall recess since they were greater than 6 inches in depth. Another problem was that the geometry of the motor structure necessitated use of an inefficient flow pattern in order to reduce the unit's overall dimensions.

U.S. Pat. No. 3,783,472 to Mol discloses a system wherein a wall mounted vacuum cleaner is positioned within the recesses of an existing wall. In the Mol device the motor is mounted at the top of the unit and air must first be drawn downwardly through the receptacle bag, back up through the pump and finally out to an exhaust means. The Mol device thus suffers from a loss of suction head due to the rather circuitous path that the air must take in traveling through the unit. Furthermore, as debris collects within the receptacle bag, the bag will collapse and press upon the walls of the housing, impeding air flow and causing a loss of suction power.

U.S. Pat. No. 3,706,184 to Tucker also discloses a wall recessed suction cleaner. In Tucker, the suction unit is mounted beside and parallel to an air filter canister which is removable as a unit for servicing. The air and suspended dirt particles are forced to change direction several times in order to pass through the various system components. The flow path required by Tucker causes a loss of suction head and a tendency for dirt to fall from suspension and accumulate at the various bends and turns.

Thus, if it were possible to design a self-contained vacuum cleaning system that was sufficiently compact so as to allow it to be fully recessed in any wall construction and simultaneously provide powerful and reliable cleaning without loss of efficiency as debris is collected, a long felt need in the art would be satisfied.

SUMMARY OF THE INVENTION

The present invention is directed to improvements in the operation and design of wall-mounted recessed vacuum cleaner systems. The self-contained vacuum cleaning system is characterized by an open-faced housing adapted to be recessed within a standard wall construction; a cover frame assembly adapted to sealingly engage the housing; means for ingress of dirt laden air, for example a vacuum hose coupling adapter used singly or in plural as part of a branched fitting, e.g. a T-fitting; a means for egress of clean air, for example an exhaust port formed within the cover frame assembly or alternatively a port formed in the housing, preferably the rear wall of the housing; a vacuum motor assembly positionable within said housing; an air filtration and debris collecting assembly for retention of dirt and debris; and an air flow path maintaining means positioned within the housing so as to maintain maximum suction power and optimum airflow. The invention advantageously incorporates an extremely compact motor design which enables the filtering debris receptacle to be arranged directly over the motor housing. The novel positioning of components and compact motor design result in a device having a depth of only 3⅞ inches. The arcuate projection of the front cover frame adds 13/16 inch resulting in a device having a total depth of only 4 11/16 inches. The minimal depth required for installation permits placement of the unit in any partition structure, for example gypsum board walls, plaster walls, and fiberglass or metal panels found in boats or recreational vehicles. To operate the unit one simply attaches the appropriate hose, which is adapted to slidably fit within the hose coupling, and activates the motor via the motor actuator means, e.g. a switch provided in the cover frame assembly. The cover frame assembly further includes an electrical power supply receptacle integrally mounted therein. When incorporated in new construction, an alternative embodiment provides for the inclusion of a branched or T-fitting in fluid communication with the inlet conduit structure. The use of a T-fitting allows for extension of the conduit to a second room or floor. In such an installation a plurality of vacuum hose coupling devices are utilized containing a parallel electrical interlock formed integral with the hose coupling which serves to activate the motor upon insertion of the hose in any one of the plural devices.

The wall-mounted vacuum system of the instant invention is characterized by an upper containment compartment and a lower evacuation compartment. The containment compartment houses an air filtering and residue collecting receptacle, e.g. a vacuum bag assembly. The evacuation compartment houses the flow-thru motor assembly. The system components are constructed and arranged so as to mount within an open-faced rectangular housing having a rear wall and four side walls. The housing may be formed of stainless steel or galvanized sheet metal. Alternatively, the housing may be molded from ABS or a polycarbonate/ABS blend. The sidewalls have an innermost edge abutting the rear wall and an outermost edge. The minimal depth of the housing enables it to fit within the recess created when an opening is formed between the studs of a standard wall construction. A peripheral flange extends perpendicularly from the sidewalls at the outermost edge thereof so as to provide a rigid surface for firmly positioning the housing adjacent to the wall face. The sidewalls are further formed so as to receive particularly spaced positioning members which support the internal components while simultaneously insuring unimpeded airflow between the containment and evacuation compartments. These positioning members may be in the form of upstanding ridges or alternatively may constitute channels which may be machined or molded into the sidewall construction. The evacuation compartment, containing the flow-thru motor assembly draws air in a downward direction through the system.

A chamber separating assembly containing a bag supporting grid element, a motor protecting filter element and a motor shroud element, is situated between the motor housing and the air filtering and collection receptacle. The chamber separating assembly serves a two-fold function. Firstly, the spaced relationship of the bag support grid element, motor protecting filter element and motor shroud provide support for the air filtration and debris collecting receptacle above the motor housing and help to insure a uniform and unimpeded flow of air to the suction fan and motor housing. Secondly, the underside of the motor shroud provides a downwardly directed member which frictionally engages the flow-thru motor assembly so as to provide reliable and rigid support therefore.

In order to prevent a reduction in the ability of air to flow through the system as debris collects within the receptacle a vertical baffle assembly is designed to be positioned in spaced relation to the sidewalls and rearwall of the housing. The positioning of these vertical baffles allows optimum air flow to be maintained between the upper portion of the housing, termed the containment chamber and the lower portion of the housing, termed the evacuation chamber, even as the collection receptacle becomes filled during use.

Thus it is an objective of the instant invention to provide a self-contained vacuum cleaning system of an ultra-compact design which enables it to be completely recessed within any wall construction.

It is a further objective of the instant invention to teach a vacuum cleaning system that maintains maximum cleaning power and optimum air flow.

It is a still further objective of the instant invention to teach a vacuum cleaning system having improved sealing during operation.

It is yet another objective of the instant invention to teach a vacuum system wherein one housing assembly is capable of being utilized by more than one room via the incorporation of a branched fitting, e.g. a T-coupling.

It is an additional objective of the invention to teach a vacuum hose coupling adaptor which has both a sealing inlet cover and an electrical interlock which initiates power to the motor upon insertion of the vacuum hose.

It is yet another objective of the instant invention to teach a vacuum cleaning system wherein the exhaust air is directed along a secondary path which causes it to exit from a port located in the rear wall of the housing, thereby preventing any exhaust from being directed back into the room and providing enhanced noise reduction.

It is still a further objective of the instant invention to provide a self-contained vacuum cleaning system which may be flush mounted upon a wall surface and wherein the vacuum hose may be adapted to be stored upon the system housing.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

With reference to the accompanying figures, like numerals refer to like elements.

Figure 1:
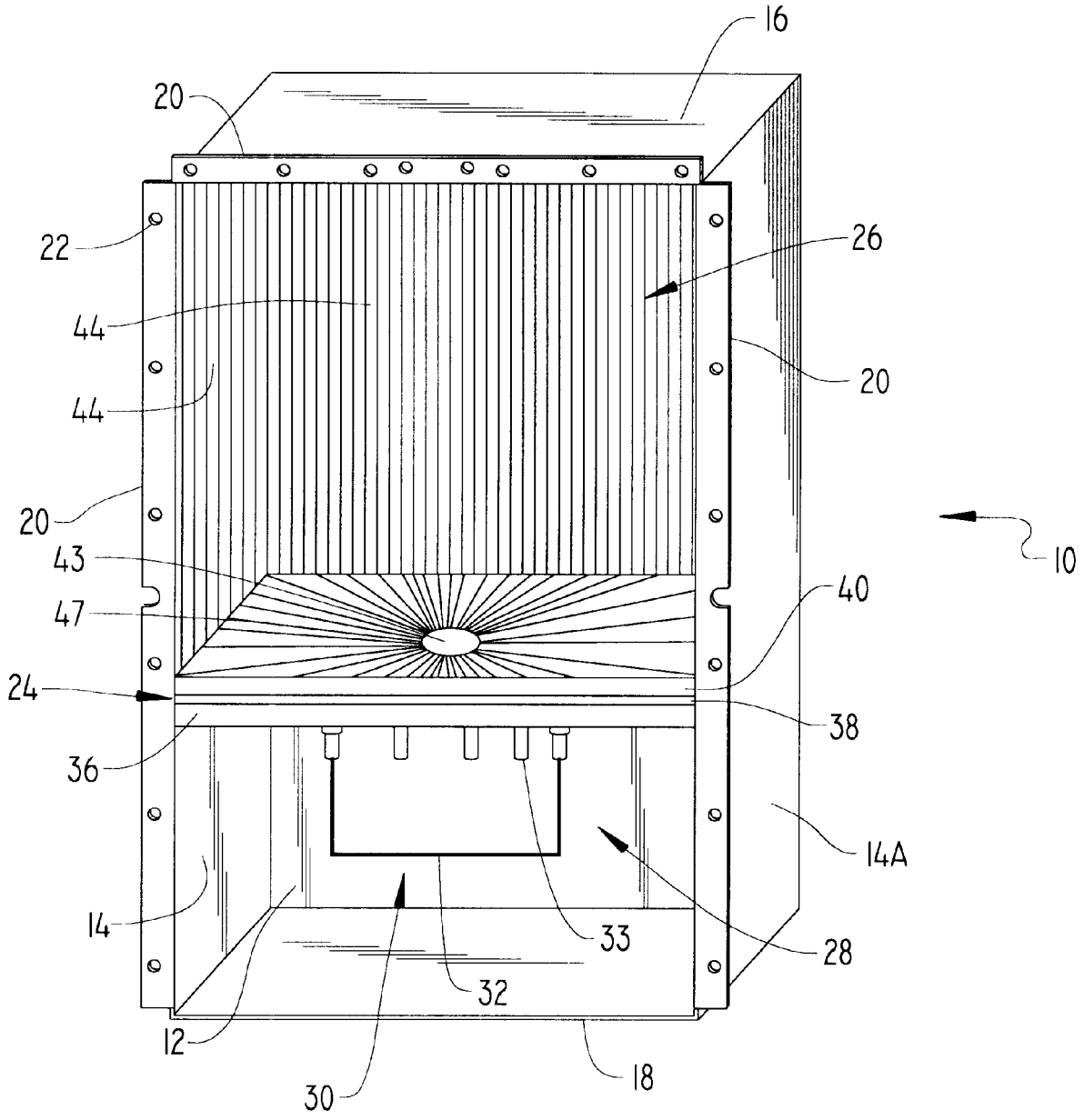
FIG. 1 is a front plan view of the vacuum system with the assembly removed.

FIG. 1 is a front plan view of the self-contained vacuum system of the present invention with the cover frame assembly removed. The device resides within an open-faced rectangular housing 10 having a rear wall 12 two side walls 14,14A, a top wall 16 and a bottom wall 18. The top wall and adjacent side walls each have a perpendicular flange 20 adjacent the front face thereof containing a series of spaced perforations 22. These perforations aid in the accurate positioning of the cover frame assembly 50 (see FIG. 4) by accepting alignment tabs 52 which are molded about the perimeter of the rear side of the cover frame assembly.

Figure 4:
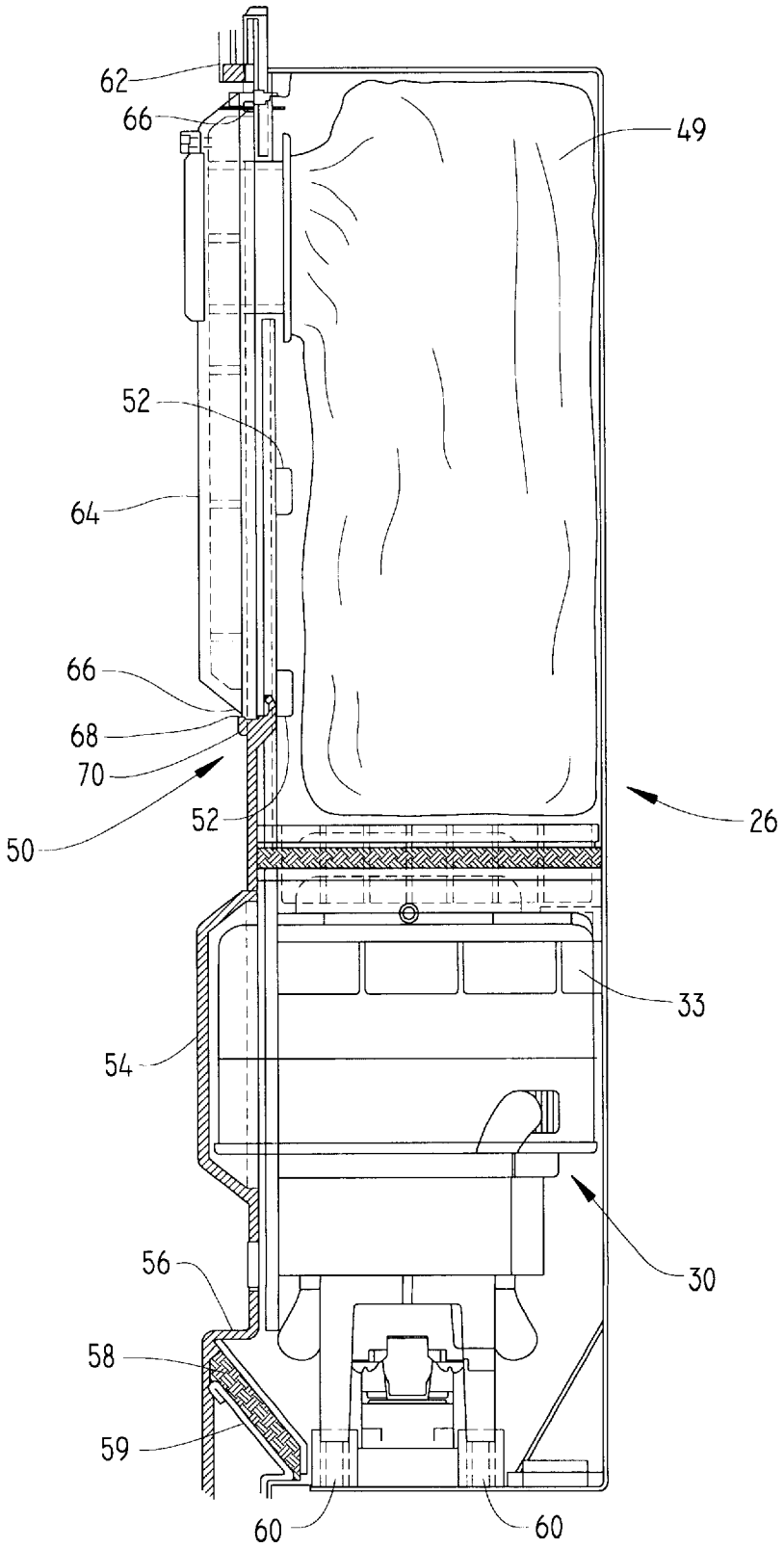
FIG. 4 is a side plan view of the vacuum system.

Within the housing 10, chamber separating assembly 24 sub-divides the housing into two main sections. This assembly is defined by a motor shroud 36, a mesh filter media 38, for example a fiberglass mesh element, and a supporting grid element 40. The motor shroud is adapted to be fastened to the side walls of the housing by insertion of a mechanical fastening means, e.g. a screw or the like, through a pre-existing perforation in the sidewall and into a reinforced reception area in the shroud. The lowermost side of the motor shroud contains an upstanding and generally circular flange adapted to frictionally engage the flow-thru motor assembly 30 so as to precisely position the source of vacuum beneath the shroud. Directly above the flow-thru motor assembly, the motor shroud contains a plurality of upstanding rigid members or baffles which are circumferentially spaced about a central circular member 43. The uppermost section or containment chamber 26 contains the air filtering and debris collection receptacle 49, as best seen in FIG. 4, which in a preferred embodiment may be a standard vacuum cleaner bag, and in a particular embodiment may exhibit HEPA filtration characteristics. Vertical baffle assemblies 44 are situated within the containment chamber along the rear and side walls as shown. These assemblies are utilized to insure that optimum air flow is maintained through the containment chamber. The baffle assemblies are in the form of a plurality of insertable members which contain vertical ribs in spaced relation to the housing sidewalls and rearwall so as to thereby create an area for unrestricted air flow throughout the containment chamber. Absent such baffle assemblies, prior art systems suffered from poor suction power as the bag filled and collapsed against the walls of the housing, thus blocking,even flow of air through and around the bag. The baffle assemblies are designed to be easily and readily insertable within the housing where they frictionally engage the inner surfaces thereof. The innermost edges of the grid members are chamfered so as to provide rigid engagement and full vertical support when assembled. The lower section or evacuation chamber 28 contains the flow-thru motor housing assembly 30 which is comprised of a compact flow-thru vacuum motor 32 which draws air therethrough so as to create an area of lower pressure within the containment chamber.

Figure 2A:
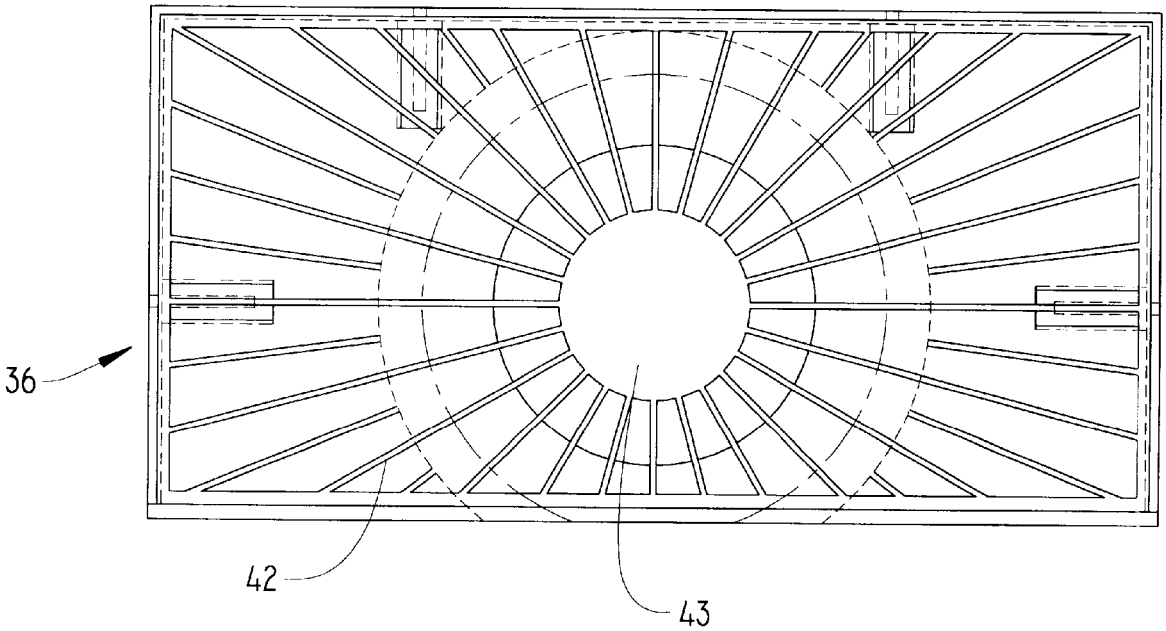
FIG. 2*a* is a top view of the motor shroud.
Figure 2B:
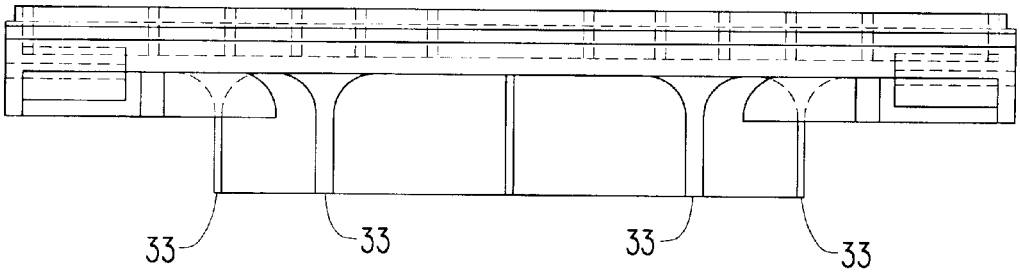
FIG. 2*b* is a front view of the motor shroud.

Referring to FIGS. 1, 2*a* and 2*b,* the motor shroud 36 is sized so as to completely fill the cross-sectional area of the housing above the motor assembly 30. The shroud is constructed and arranged so that the lowermost side includes plural members 33 to rigidly engage the motor housing assembly. In a preferred embodiment, an additional retention means, such as an adjustable hose clamp (not shown) can be utilized to increase the frictional force which retains the motor assembly within the shroud. The uppermost side of the motor shroud is provided with a plurality of upstanding ribs 42 which maintain a space for air flow and further act to channel the air flow toward the centrally disposed flow-thru motor housing assembly.

Figure 3:
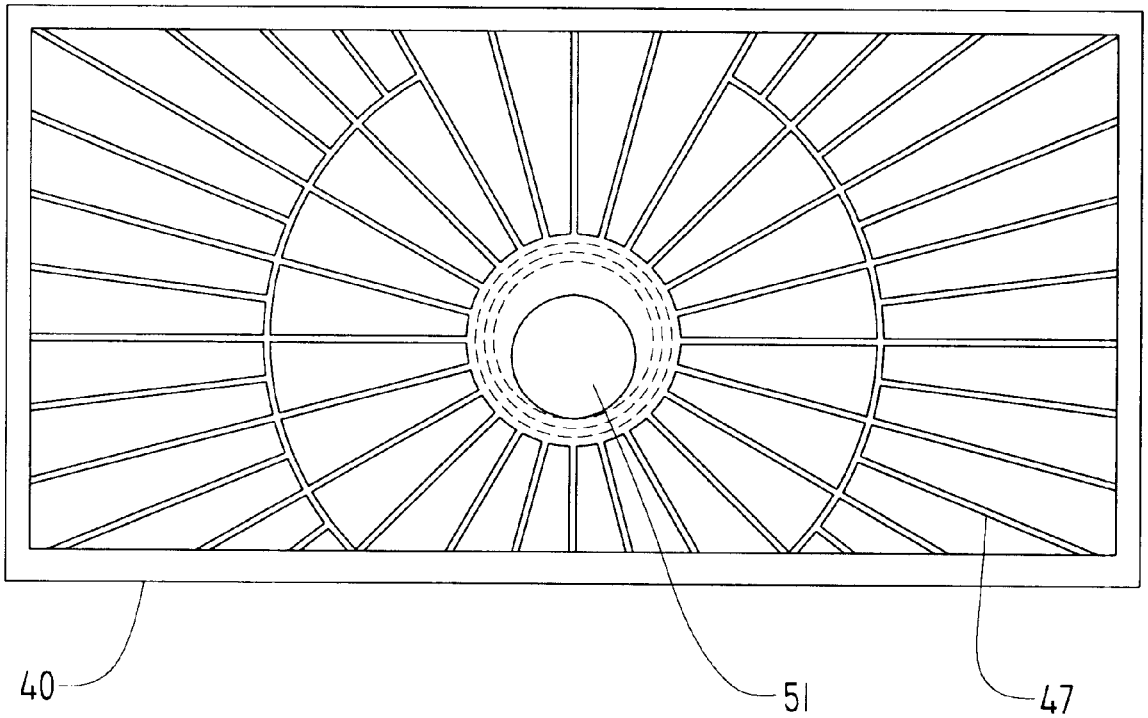
FIG. 3 is a top view of the supporting grid element.

Referring to FIGS. 1 and 3, supporting grid element 40, termed a bag grid, is positioned above the mesh filter element 38. This member, which in a preferred embodiment is formed from a flame retardant ABS resin, contains a plurality of baffles 47 circumferentially spaced about a central finger grip 51 and designed to provide rigid support for the overlying bag. As the bag fills with accumulated debris, there is a tendency for material to collect unevenly within the bag. The bag grid provides overall support along the bottom of the bag structure thereby preventing the mesh filter from being deformed. By fully supporting the bag and preventing filter deformation, uniform flow rate is maintained throughout the vacuum cleaner assembly and efficient cleaning can be attained.

Referring to FIG. 4, a side plan view of the vacuum system is shown. The cover frame assembly 50 extends the full length of the housing. It contains a plurality of alignment tabs 52 which are adapted to be inserted within perforations 22 in peripheral flanges 20 (FIG. 1) thereby insuring precise positioning. The cover frame assembly contains an arcuate area 54 designed to accommodate the motor assembly 30. At the lowermost edge of the cover frame assembly, a compartment is formed which is adapted, e.g. by the inclusion of a metal mesh or equivalent backing plate 56 to hold a final filter element 58. This element, which is angled so as to maximize its area and thus minimize back pressure at the exhaust port, is retained by removable retention clip 59. The final filter element protects the floor near the exhaust port by trapping fine carbon powder which is generated as the motor's brushes bear against the armature during normal operation. Studs 60 firmly attach the motor assembly 30 to the bottom wall 18 of housing 10. At the uppermost edge of the cover frame assembly, a latch receiving area 62 is formed which retains a molded latch 65 more particularly described in FIG. 5. The latch is capable of vertical reciprocating motion so as to enable it to secure the air collection and debris collecting or containment chamber access panel 64. Access panel 64 is formed with a small groove 66 along the perimeter of its rear face within which a resilient sealing member, e.g. an elastomeric O-ring (not shown) is positioned. Access panel 64 further contains an inlet cover 72 hingeably attached and juxtaposed to the vacuum hose coupling adapter 74, which is adapted on a first outer side thereof for fluid communication with a vacuum hose and further adapted, on a second inner side thereof, for fluid communication with an air filtration and debris collecting receptacle. The inlet cover is normally maintained flat against the access panel thereby sealing the coupling area when the vacuum is not in operation.

In an alternative embodiment, a T-coupling (not shown) may be substituted for the coupling adapter 74. In this case the access cover is sealed in the area of the inlet cover 72 and an alternative vacuum hose adapter coupling is included above the top wall and having a secondary conduit which extends to an adjacent room area. In such an embodiment, each vacuum hose adapter coupling has both a sealing inlet cover and an electrical interlock which initiates power to the motor upon insertion of the vacuum hose. The reduced pressure within the containment chamber during operation of the flow-thru motor urges the elastomeric O-ring into sealing engagement with the cover frame assembly thereby maintaining a hermetic seal. When closing the containment chamber, the lowermost flange 68 of the access panel is inserted behind mating flange 70 of the cover frame assembly, the panel is held against the cover frame assembly and the latch 64 is engaged. The act of latching the access panel causes the O-ring to be urged against the cover frame thereby bringing the O-ring into sealing engagement with the cover frame assembly.

In a further alternative embodiment, the air is directed along a secondary path which causes it to exit from a port in the rear wall of the housing, thereby preventing any exhaust from being directed back into the room and providing for more quiet operation.

In still another alternative embodiment, the entire vacuum cleaning system may be adapted to be flush mounted upon a wall surface and a power cord is then provided for attachment to a standard electrical outlet. In such an embodiment the vacuum hose may be adapted to be stored upon the housing itself.

Figure 5:
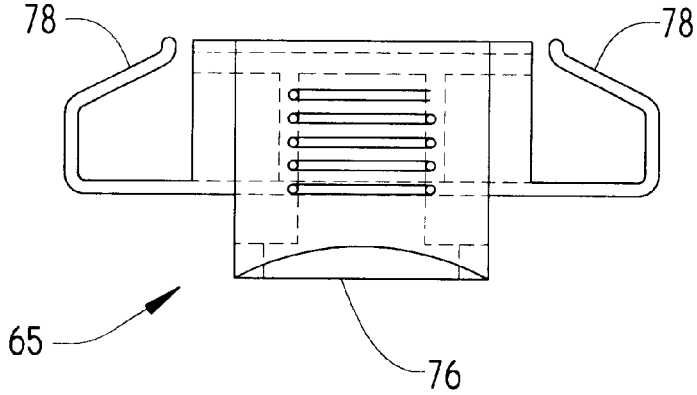
FIG. 5 is a front view of the access panel latch.

Referring now to FIG. 5, molded latch 65 is shown. The latch is preferably formed from a nylon or acetal resin. The latch is designed to fit with extremely close tolerance within latch receiving area 62 (see FIG. 4). The lowermost edge 76 of the latch is urged downwardly due to compressive forces developed by resilient ears 78 as they are retained within the cavity 62. This insures positive engagement of the latch with the access panel. Operator intervention is thus necessary to deflect the latch upwardly, thereby disengaging the access panel and allowing opening thereof.

Figure 6:
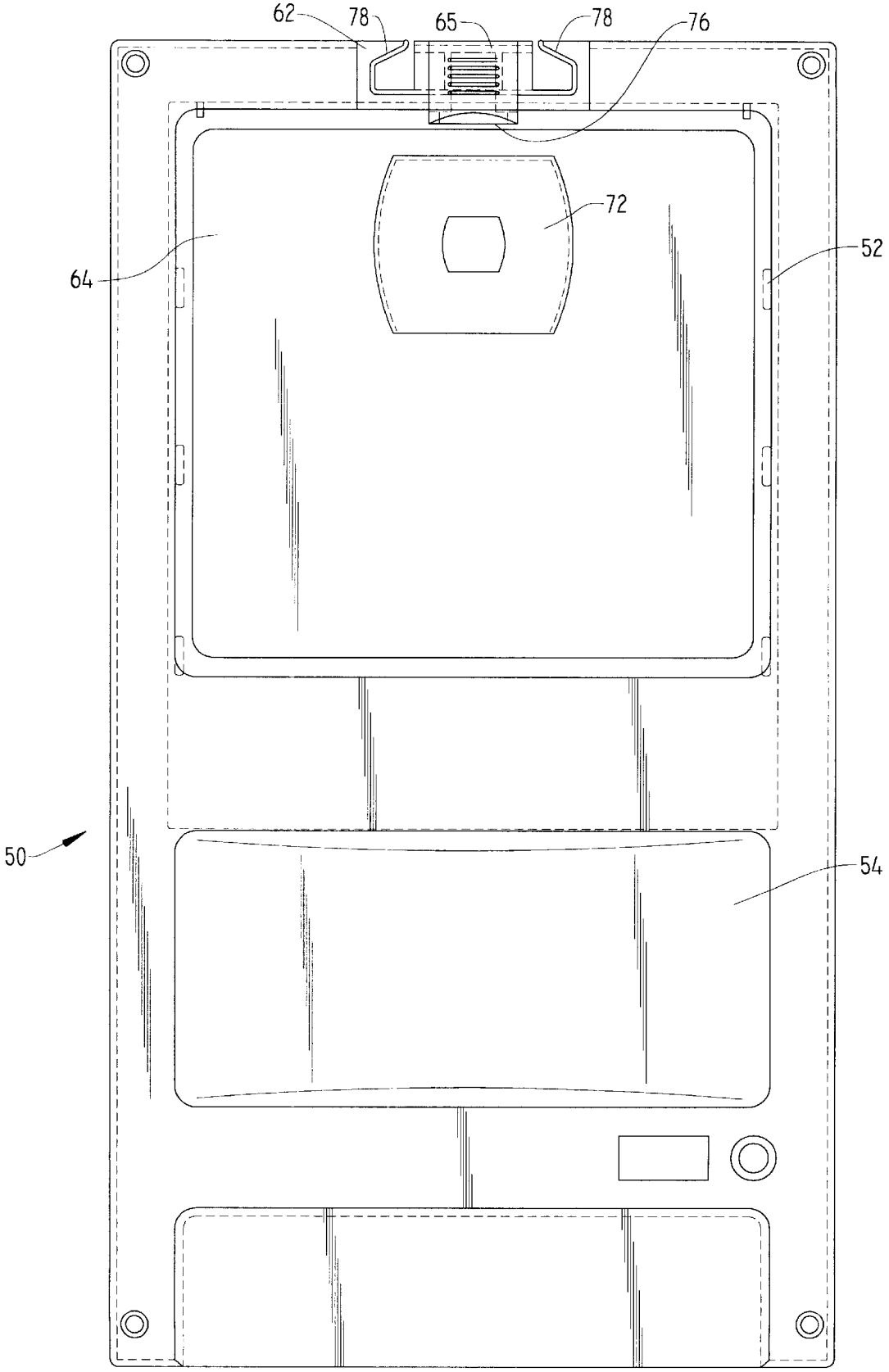
FIG. 6, is a front plan view of the cover assembly.

With reference to FIG. 6, a front plan view of the cover assembly 50 is shown. Cover assembly 50 is shown, including alignment tabs 52, an arcuate area 54 designed to accommodate the motor assembly 30 (not shown), a latch receiving area 62 is formed which retains a molded latch 65, constructed and arranged for vertical reciprocating motion so as to enable it to secure the air collection and debris collecting or containment chamber access panel 64. Access panel 64 further contains an inlet cover 72 hingeably attached and juxtaposed to the vacuum hose coupling adapter 74 (not shown), which is adapted on a first outer side thereof for fluid communication with a vacuum hose and further adapted, on a second inner side thereof, for fluid communication with an air filtration and debris collecting receptacle. The inlet cover is normally maintained flat against the access panel thereby sealing the coupling area when the vacuum is not in operation. When closing the containment chamber access panel 64, the lowermost flange 68 of the access panel is inserted behind mating flange 70 of the cover frame assembly, as best seen in FIG. 4. The panel is held against the cover frame assembly and the latch 65 is engaged. The engagement of the latch is accomplished by first urging the latch upwardly against the downward biasing forces exerted by resilient ears 78. This allows clearance so that the access cover can be seated in its closed position. Upon release of the latch 65 by the operator, the lowermost edge 76 of the latch is urged downwardly due to compressive forces developed by resilient ears 78 as they are retained within the cavity 62. This insures positive engagement of the latch with the access panel. Operator intervention is again necessary to deflect the latch upwardly, thereby disengaging the access panel and permitting the opening thereof when desired.

Figure 7:
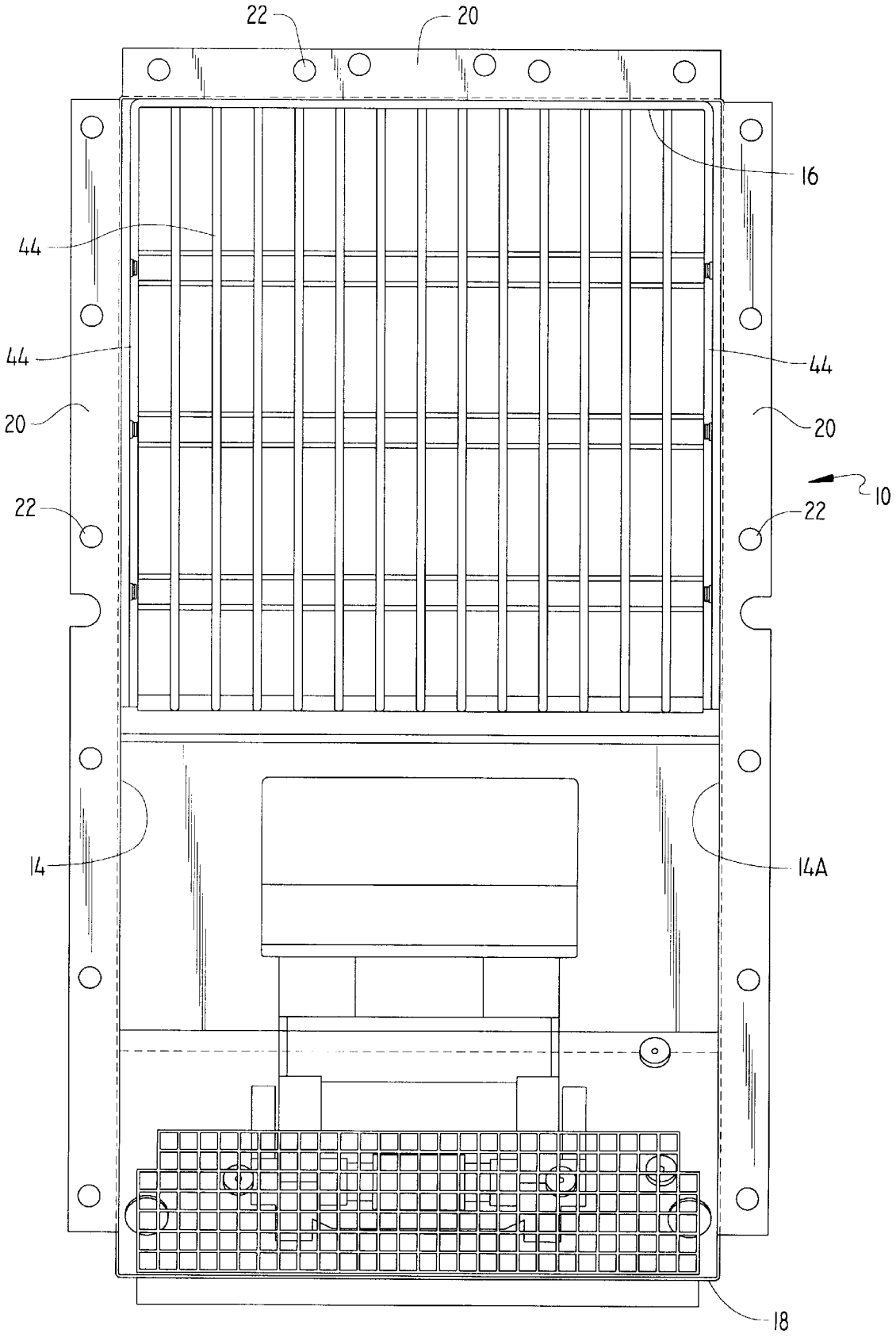
FIG. 7 is a cross-sectional view of the open-faced rectangular housing with the cover frame assembly removed.

With reference to FIG. 7 a cross-sectional view of the openfaced rectangular housing 10 is illustrated with the cover frame assembly removed. The housing has a rear wall 12 (not shown) and two side walls 14, 14A, a top wall 16 and a bottom wall 18. The top wall and adjacent side walls each have a perpendicular flange 20 adjacent the front face thereof containing a series of spaced perforations 22 to aid in mounting and assembly. Vertical baffle assemblies 44 are situated within the containment chamber along the rear and side walls as shown. These assemblies are utilized to insure that optimum air flow is maintained through the containment chamber. The baffle assemblies 44 are in the form of a plurality of insertable members which contain vertical ribs in spaced relation to the housing sidewalls and rearwall so as to thereby create an area for unrestricted air flow throughout the containment chamber. Absent such baffle assemblies, prior art systems suffered from poor suction power as the bag filled and collapsed against the walls of the housing, thus blocking even flow of air through and around the bag. The baffle assemblies are designed to be easily and readily insertable within the housing where they frictionally engage the inner surfaces thereof. The innermost edges of the grid members are chamfered so as to provide rigid engagement and full vertical support when assembled.

Figure 8A:
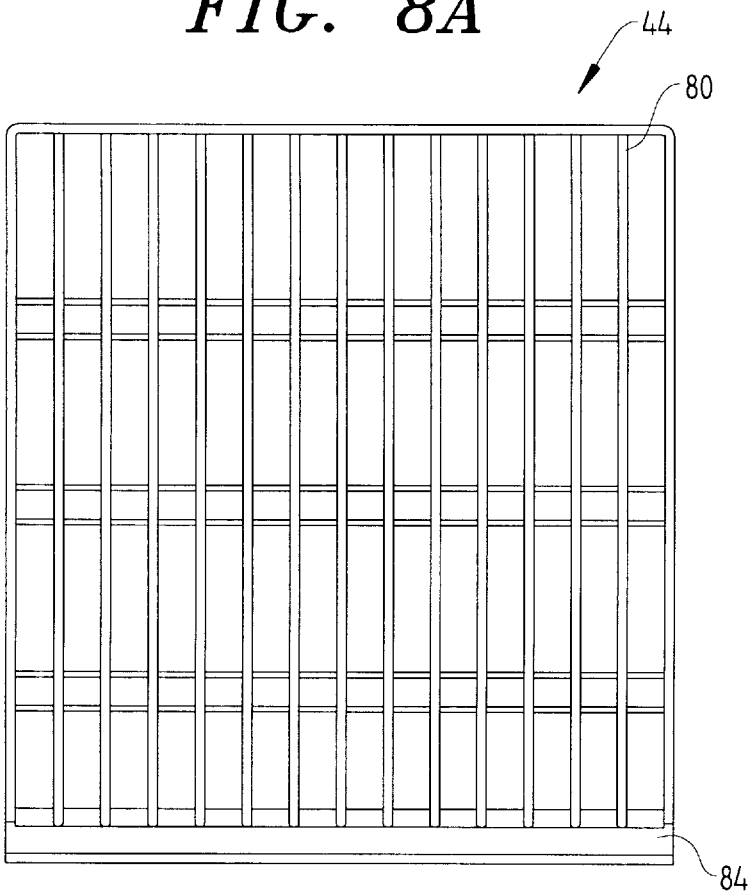
FIGS. 8*a,* 8*b* and 8*c* are an orthographic projection view of a vertical baffle assembly.
Figure 8B:
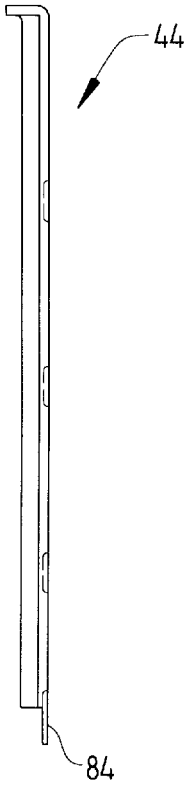
Figure 8C:
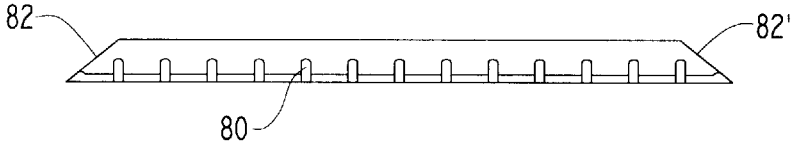

With reference to FIGS. 8*a,* 8*b* and 8*c* a vertical baffle assembly 44 is shown in orthogonal projection. Front view FIG. 8*a* shows the vertical ribs 80 in spaced relation from the adjacent wall. The profile of these ribs 80 is best seen via bottom view 8*c*. Further in FIG. 8*c* the edges of the grid members 82 and 82' are shown to be chamfered so as to provide rigid engagement and full vertical support when assembled FIG. 8*b* shows a side view of baffle 44 and particularly shows integral member 84 in said baffle assemblies, which member protrudes downwardly and acts as a support and positioning element for the chamber separating assembly.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A self-contained vacuum cleaning system comprising:

a rectangular housing having a rear wall, two sidewalls, a top wall and a bottom wall, said sidewalls, top and bottom walls being adjacent to said rear wall and perpendicular thereto, said sidewalls and top wall further having a peripheral flange extending outwardly and perpendicularly therefrom, said housing being constructed and arranged so as to define a containment chamber and an evacuation chamber therein;

a cover frame assembly in sealing engagement with said housing further including a containment chamber access panel adapted to sealingly engage the perimeter of an aperture in said cover frame assembly, a vacuum hose coupling adapted, on a first outer side thereof, for fluid communication with a vacuum hose and further adapted, on a second inner side thereof, for fluid communication with an air filtering and debris collecting receptacle, and an evacuation chamber exhaust port;

vertical baffle assemblies positioned in spaced relation to the sidewalls and rear wall of said housing so as to maintain optimum air flow between said containment chamber and said evacuation chamber;

a chamber separating assembly containing, in spaced relation, a supporting grid element, a motor protecting filter element and a motor shroud element, said chamber separating assembly being supported and positioned by integral members in said baffle assemblies;

said cleaning system characterized by the containment chamber and evacuation chamber being in stacked relation whereby activation of a motor driven vacuum pump situated in the evacuation chamber causes air to be drawn along a straight-thru flowpath through the containment chamber causing debris to be collected in said receptacle.

2. The self-contained vacuum cleaning system of claim 1 wherein said motor driven vacuum pump comprises a flow-thru vacuum motor.

* * * * *